US006890364B2

(12) United States Patent
Delfort et al.

(10) Patent No.: US 6,890,364 B2
(45) Date of Patent: May 10, 2005

(54) DIESEL FUEL COMPOUNDS CONTAINING GLYCEROL ACETALS

(75) Inventors: Bruno Delfort, Paris (FR); Isabelle Durand, Rueil Malmaison (FR); Anne Jaecker, Rueil Malmaison (FR); Thierry Lacome, Condecourt (FR); Xavier Montagne, Rueil Malmaison (FR); Fabrice Paille, Limay (FR)

(73) Assignee: InstitutFrancais du Petrole, Rueil Malmaison Cedex (FR)

( * ) Notice: Subject to any disclaimer, the term of this patent is extended or adjusted under 35 U.S.C. 154(b) by 189 days.

(21) Appl. No.: 10/322,760

(22) Filed: Dec. 19, 2002

(65) Prior Publication Data

US 2003/0163949 A1 Sep. 4, 2003

(30) Foreign Application Priority Data

Dec. 19, 2001 (FR) ..... 01 16449

(51) Int. Cl.[7] ..... C10L 1/18

(52) U.S. Cl. ..... 44/349; 44/350; 44/351; 44/352; 44/444

(58) Field of Search ..... 44/350, 351, 352, 44/444, 349

(56) References Cited

U.S. PATENT DOCUMENTS

| | | | | | |
|---|---|---|---|---|---|
| 3,577,228 | A | | 5/1971 | Rai et al. | |
| 3,594,138 | A | | 7/1971 | Radin | |
| 3,811,847 | A | * | 5/1974 | Andress et al. | 44/349 |
| 4,395,267 | A | * | 7/1983 | Sweeney | 44/444 |
| 4,906,253 | A | * | 3/1990 | Walsh | 44/350 |
| 5,268,007 | A | * | 12/1993 | Walsh | 44/350 |
| 5,308,365 | A | * | 5/1994 | Kesling et al. | 44/447 |
| 6,013,114 | A | * | 1/2000 | Hille et al. | 44/308 |
| 6,113,661 | A | * | 9/2000 | Germanaud et al. | 44/444 |

FOREIGN PATENT DOCUMENTS

| | | |
|---|---|---|
| DE | 1959388 | 6/1970 |
| EP | 0718270 | 6/1996 |
| WO | 95/33022 | 12/1995 |
| WO | 99/66009 | 12/1999 |
| WO | 00/17290 | 3/2000 |

* cited by examiner

*Primary Examiner*—Cephia D. Toomer
(74) *Attorney, Agent, or Firm*—Millen, White, Zelano & Branigan, P.C.

(57) ABSTRACT

A diesel fuel compound has a major proportion of at least one diesel fuel and a minor proportion of at least one glycerol acetal corresponding to one of general formulas:

(1)

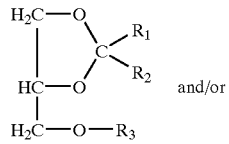

and/or (2)

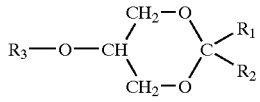

in which:

R1 and R2 each represent a hydrogen atom, a hydrocarbon radical with 1 to 20 carbon atoms, aliphatic, cycloaliphatic or aromatic, or an alkyl-ether chain, R1 and R2 being able together to form an oxygenated heterocyclic radical;

R3 represents a hydrogen atom or a radical of general formula:

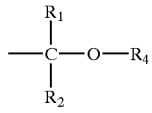

where R4 is a radical defined as R1 or R2, except for the hydrogen atom, or a radical of general formula:

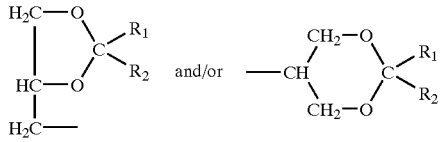

where R1 and R2 are defined as above, the sum of the number of carbon atoms of R1, R2 and R3 in formulas (1) and (2) being at least 2 and it has no metal compounds of group IIA.

9 Claims, No Drawings

DIESEL FUEL COMPOUNDS CONTAINING GLYCEROL ACETALS

The invention relates to diesel fuel compounds containing oxygenated compounds consisting essentially of glycerol acetals.

The improvement of air quality today is an absolute, priority of all the large industrial countries. Among the emitters of said pollutants, transportation occupies a place that demands that significant measures be taken to reduce its contribution. Thus reams of regulatory measures have seen the light of day for several years, with new constraints starting in 20000, notably specifications concerning fuel quality. Indeed, besides the conventionally specified features, new regulations concerning the chemical composition of fuels have appeared, with the goal of limiting certain pollutant precursors, such as particles, compounds that are reactive with tropospheric ozone, or toxic compounds. In this context, it is evident that all efforts aimed at improving product quality that offer mixtures that significantly reduce polluting byproducts are promising.

One of the objects of the invention is to propose the use of glycerol acetals as additives or as formulation bases for gas oils and leading to significant reductions in particulate emissions.

The invention thus proposes diesel fuel compounds characterized in that they comprise a major proportion of at least one diesel fuel and a minor proportion of at least one glycerol acetal corresponding to one of the following general formulas:

(1)

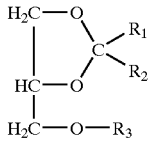

and/or (2)

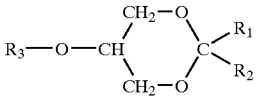

in which:

R1 and R2 each represent a hydrogen atom, a hydrocarbonic radical of 1 to 20 atoms of carbon, aliphatic, linear, or branched, saturated or not, cycloaliphatic, or aromatic, or an alkyl-ether chain, R1 and R2 being able together to form an oxygenated heterocyclic radical (for example furanic or tetrahydrofuranic);

R3 represents a hydrogen atom or a radical of general formula:

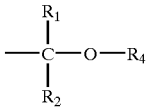

where R4 is a radical defined as R1 or R2, except for the hydrogen atom, or a radical of general formula:

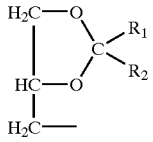

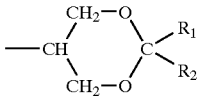

where R1 and R2 are defined as above,

The sum of the number of carbon atoms in formulas (1) and (2) being at least 2; and they have no metal compounds of group IIA.

More particularly, in the glycerol acetal formula, R1 and R2 are each a hydrogen atom, a methyl, ethyl or propyl radical and R3 is a methyl or ethyl radical.

The introduction of products corresponding to general formulas (1) and (2) above into gas oil and/or into a mixture of vegetable oil esters leads to diesel motor fuels making it possible to reduce polluting emissions, notably particulate emissions, with respect to a fuel not containing the products in question. The products used in these diesel motor fuels can be made up of mixtures of any products corresponding to general formulas (1) and (2).

The glycerol acetals corresponding to general formulas (1) and (2) are most often made by reaction, generally in an acidic environment, of an aldehyde or a ketone on glycerol or by a transacetalization reaction. These reactions, applied to an R—OH alcohol, are represented by the following diagrams:

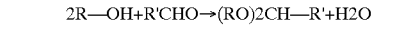

(3)

(4)

Applied to glycerol, there are multiple acetalization or transacetalization reactions. Some of them can be written according to the following diagrams:

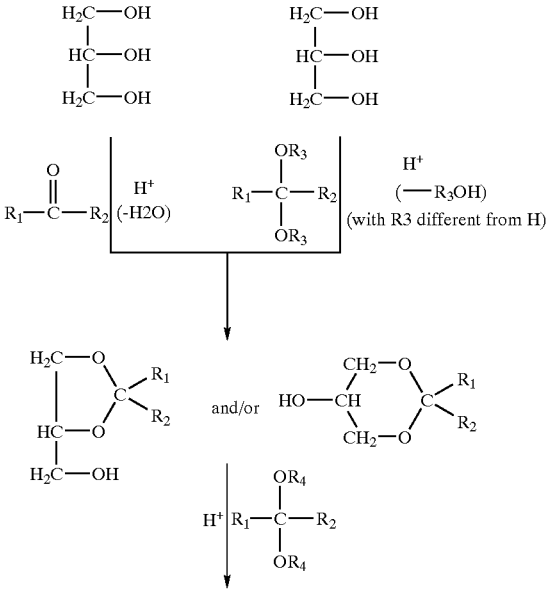

-continued

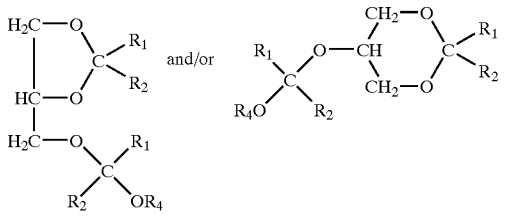

These reactions, applied to glycerol, are described, for example, in the following publications:

| | |
|---|---|
| Piantadosi et al, | J. of Am. Chem. Soc, (1958), 6613 |
| Gelas et al | Bull Soc Chim Fr, (1969), No. 4, 1300 |
| | Ibid, (1970), No. 6, 2341, |
| | Ibid, (1970), No. 6, 2349, |
| Gelas et al | CR. Ac. Sc. Paris (1970), 218. |

In the diesel fuel compositions according to the invention, the diesel fuel in question can be of petroleum origin or a mixture of alkylic esters derived from vegetable oils.

The diesel fuel compounds of the invention can contain glycerol acetals in various proportions. The glycerol acetal or each of the glycerol acetals will be introduced into the diesel fuel at a concentration such that it is soluble in said diesel fuel. Depending on the case, proportions of 1 to 40% by volume, most often 1 to 20% by volume, is used.

The following examples illustrate the invention in a nonlimiting way.

EXAMPLES

In examples 1 to 3, the synthesis of glycerol acetals is described. Example 4 describes evaluation tests of the performance of gas oil compounds that contain the glycerol acetals prepared in examples 1 to 3.

Example 1

920 g (10 moles) of glycerol, 790.3 g (10.96 moles) of n-butyraldehyde and 24 g of an Amberlyst 15® acid resin are introduced into a reactor. The conditions are brought to 54° C. while stirring for 7 hours, during which 120 g of n-butyraldehyde is introduced.

The reaction is the following:

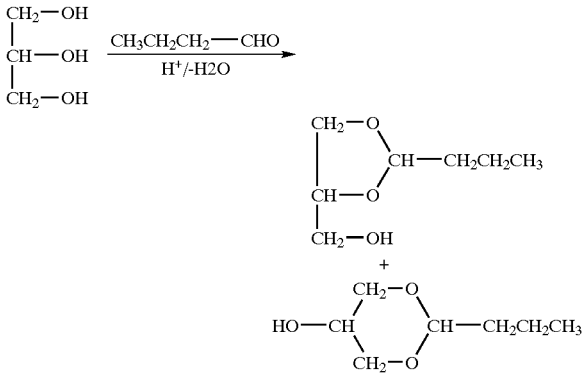

The product generally exists in the two isomeric forms represented above.

After returning to ambient temperature, the catalyst is eliminated by filtration, then the excess n-butyraldehyde as well as the water of the reaction are eliminated by evaporation under reduced pressure. 1165 g of a limpid liquid soluble in gas oil is obtained, whose elementary analysis is the following:

C=56.7% by mass

H=10.1% by mass

O=33.2% by mass.

Example 2

Example 1 is reproduced by replacing the n-butyraldehyde with an equimolar amount of formaldehyde (monomeric or in its cyclic trimeric form called trioxane).

The reaction is the following:

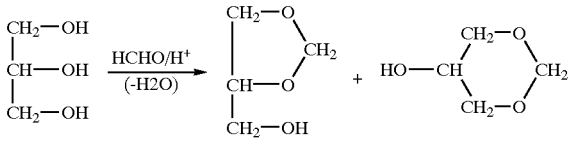

The product generally exists in the two isometric forms represented above.

156 g (1.5 mole) of the product, 500 g (4.8 moles) of diethoxymethane and 3 g of an Amberlyst 15® acid resin are introduced into a reactor.

The reactions are the following:

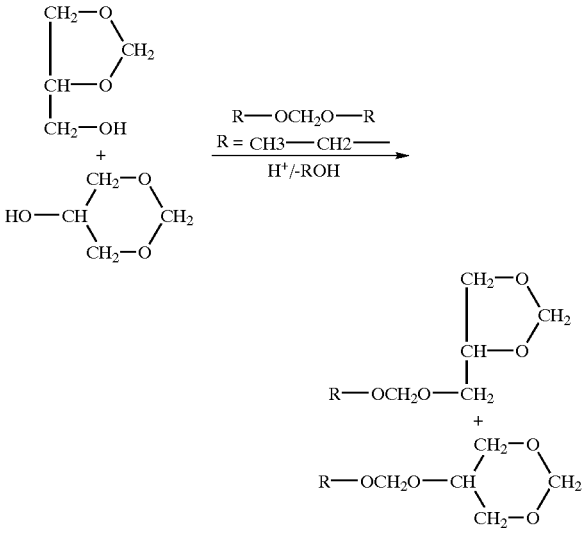

The conditions are maintained at ambient temperature while stirring for 4 hours, then the catalyst is eliminated by filtration and the reagents and excess products are evaporated under reduced pressure. The operation is repeated until 210 g of a product soluble in gas oil is obtained whose elementary analysis is the following:

C=50.6% by mass

H=8.55% by mass

O=40.8% by mass.

The complete operation described in this example is repeated so as to obtain 1 liter of product.

Example 3

60 g (0.65 mole) of glycerol, 250 g (2.1 moles) of 1,1-dicthoxyethane and 2 g of an Amberlyst 15® acid resin are introduced into a reactor. The conditions are maintained at ambient temperature while stirring for four hours, then the catalyst is eliminated by filtration and the reagents and the excess products are evaporated under reduced pressure. 81 g of a limpid liquid soluble in gas oil is collected whose elementary analysis is the following:

C=54.1% by mass

H=8.7% by mass

O=37.2% by mass.

The complete operation illustrated by this example is repeated so as to obtain 1 liter of product.

Example 4

Tests were performed with the objective of evaluating the performances of the gas oil compounds containing the glycerol acetals prepared in the preceding examples.

The particulate emissions measured with these fuels will be compared to those obtained with gas oil alone.

The tests were performed with a representative gas oil from Euro 2000 formulations:

| | |
|---|---|
| density at 15° C.: | on the order of 0.832; |
| sulfur content: | on the order of 300 ppm; |
| ketane index: | on the order of 53; |
| distillation range: | 170/366° C. |

The tests were conducted with a diesel vehicle equipped with a direct injection engine.

These tests were performed over the cycle imposed by European directive 70/220/CE, modified by directive 98/69/EC (cycle called MVEG-11s Euro 2000). This cycle consists of an urban phase (ECE cycle with a length of 4.052 km) and a suburban phase (EUDC cycle with a length of 6.955 km). The test results, expressed in grams of particles per kilometer, are presented for each phase of the cycle and for the complete cycle.

The results obtained are summarized in Table 1 below. They are expressed in grams of particles emitted per kilometer (g/km).

TABLE 1

| | Particle emission (g/km) | | |
|---|---|---|---|
| Fuel evaluated | ECE Cycle | EUDC cycle | MVEG cycle |
| Gas oil alone | 0.0635 | 0.0517 | 0.0560 |
| Gas oil: 95% volume + product of example 1: 5% volume | 0.0490 | 0.0421 | 0.0447 |
| Gas oil: 95% volume + product of example 2: 5% volume | 0.0511 | 0.0405 | 0.0444 |
| Gas oil: 95% volume + product of example 3: 5% volume | 0.0529 | 0.0410 | 0.0453 |

The particulate emission reductions with the fuels according to the invention vary from 16.7% to 23% over all the conditions tested in this example.

What is claimed is:

1. A diesel fuel composition characterized in that it has a major proportion of at least one diesel fuel and a minor proportion of at least one glycerol acetal corresponding to one of general formulas:

(1)

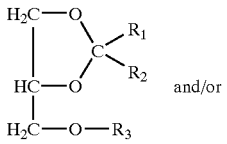

and/or (2)

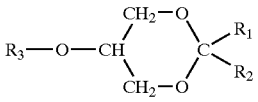

in which:

R1 and R2 each represent a hydrogen atom, or a hydrocarbon radical with 1 to 20 carbon atoms, or R1 and R2 together representing an oxygenated heterocyclic radical;

R3 represents a hydrogen atom or a radical of general formula:

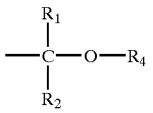

where R4 is a radical defined as R1 or R2, except for the hydrogen atom, or a radical of general formula:

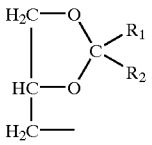

and/or

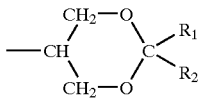

where R1 and R2 are defined as above, the sum of the number of carbon atoms of R1 , R2 and R3 in formulas (1) and (2) being at least 2, and it has no metal compounds of group IIA.

2. The diesel fuel composition according to claim 1, wherein, in the glycerol acetal formula, R1 and R2 are each a hydrogen atom, a methyl, ethyl, or propyl radical and R3 is a methyl or ethyl radical.

3. The diesel fuel composition according to claim 1, comprising a diesel fuel and a proportion of 1 to 40% by volume of at least one glycerol acetal.

4. The diesel fuel composition according to claim 1, comprising a diesel fuel and a proportion of 1 to 20% by volume of at least one glycerol acetal.

5. The diesel fuel composition according to claim 1, wherein said diesel fuel comprises a diesel fuel of petroleum origin.

6. The diesel fuel composition according to claim 1, wherein said diesel fuel comprises a mixture of alkylic esters derived from vegetable oils.

7. The diesel fuel composition according to claim 2, comprising a diesel fuel and a proportion of 1 to 40% by volume of at least one glycerol acetal.

8. A composition according to claim 1, wherein $R_3$ represents hydrogen.

9. The diesel fuel composition according to claim 8, comprising a diesel fuel and a proportion of 1 to 40% by volume of at least one glycerol acetal.

* * * * *